US008678351B2

(12) United States Patent
Siebelink

(10) Patent No.: US 8,678,351 B2
(45) Date of Patent: Mar. 25, 2014

(54) LIFT ASSIST DEVICE

(76) Inventor: Robert J. Siebelink, Wyoming, MI (US)

( * ) Notice: Subject to any disclaimer, the term of this patent is extended or adjusted under 35 U.S.C. 154(b) by 0 days.

(21) Appl. No.: 13/463,327

(22) Filed: May 3, 2012

(65) Prior Publication Data

US 2012/0280191 A1 Nov. 8, 2012

Related U.S. Application Data

(60) Provisional application No. 61/482,673, filed on May 5, 2011.

(51) Int. Cl.
*A62B 3/00* (2006.01)

(52) U.S. Cl.
USPC ..... 254/93 R; 254/94; 254/100

(58) Field of Classification Search
USPC ..... 254/93 R, 94, 100
See application file for complete search history.

(56) References Cited

U.S. PATENT DOCUMENTS

| | | | | |
|---|---|---|---|---|
| 2,411,803 | A * | 11/1946 | Parrott | 254/94 |
| 2,937,842 | A | 5/1960 | Meek | |
| 2,937,852 | A | 5/1960 | Clarke | |
| 2,964,293 | A | 12/1960 | Foth | |
| 2,966,993 | A | 1/1961 | Cooper | |
| 3,049,243 | A | 8/1962 | Buice | |
| 3,058,602 | A | 10/1962 | Kilman | |
| 3,178,038 | A | 4/1965 | Love | |
| 3,221,900 | A | 12/1965 | Love | |
| 3,246,876 | A | 4/1966 | Larson | |
| 3,967,738 | A | 7/1976 | Winings | |
| 4,120,484 | A | 10/1978 | Zimmer | |
| 4,127,255 | A | 11/1978 | Wooding | |
| 4,300,751 | A | 11/1981 | Delaney | |
| 4,474,115 | A | 10/1984 | Carlton | |
| 4,600,348 | A | 7/1986 | Pettit | |
| 5,129,774 | A | 7/1992 | Balseiro et al. | |
| 5,322,403 | A * | 6/1994 | Herde | 414/11 |
| 5,601,014 | A | 2/1997 | Stevens et al. | |
| 5,613,575 | A | 3/1997 | Ackermann | |
| 5,720,591 | A | 2/1998 | Ledet | |
| 6,273,662 | B1 | 8/2001 | Fleckenstein | |
| 6,663,084 | B1 * | 12/2003 | Butler | 254/100 |
| 7,188,843 | B2 | 3/2007 | Magness | |

* cited by examiner

*Primary Examiner* — Lee D Wilson
*Assistant Examiner* — Shantese McDonald
(74) *Attorney, Agent, or Firm* — Gardner, Linn, Burkhart & Flory, LLP

(57) ABSTRACT

A lift assist device for assisting a user in lifting an item includes a base having a center portion and a side portion that is angled relative to said center portion, a support shaft extending upward from the center portion of the base, and a support platform rotatably attached at an upper end of the support shaft and rotatable about an axis that is generally parallel to a longitudinal axis of the support shaft. The lift assist device is tiltable between a loading position, where the side portion of the base rests on a floor or support surface and the support shaft is in a tilted orientation, and a lifting position, where the center portion of the base rests on the floor or support surface and the support shaft is in a generally vertical orientation.

20 Claims, 10 Drawing Sheets

LIFT ASSIST DEVICE

CROSS REFERENCE TO RELATED APPLICATION

The present application claims the filing benefit of U.S. provisional application Ser. No. 61/482,673, filed May 5, 2011, which is hereby incorporated herein by reference in its entirety.

FIELD OF THE INVENTION

The present invention relates generally to lifting devices and, more particularly, to lifting devices for lifting an article from a ground level to a work surface or table or support surface, such as in a wood working or metal working shop or the like.

BACKGROUND OF THE INVENTION

It is known to provide lifting mechanism that raise and lower a platform to raise and lower an article relative to the support surface or ground at which the platform is positioned. Such lifting mechanisms are typically scissor-type lifting mechanism and require the article to be substantially centered and balanced on the platform before the platform may be raise to lift the article.

SUMMARY OF THE INVENTION

The present invention provides a lifting assist device or leveraged lift assist device that allows a user to place an end or a portion of a heavy article (such as a large piece of plywood or particle board or drywall or the like or such as an elongated metal or wood beam or the like) on the support platform of the lift assist device, whereby the user may readily tilt or pivot the lift assist device towards a vertical orientation to raise the other or distal end or portion of the article above the ground, so as to allow for raising the article to a table or other support by a single person. The lift assist device may be vertically nonadjustable or manually adjustable, whereby the support platform is not vertically moved relative to the base of the lift assist device during use of the device (with the user selecting and presetting the length or height of the lift assist device before use), or optionally the list assist device may be powered or automated, whereby, after the end or portion of the article is positioned at or on the support platform, the user may tilt the lift assist device toward its vertical orientation and also may lift or raise the support platform upward (such as via a linear actuator or pneumatic actuator or cylinder or the like) to raise the article to a desired height for positioning the article on a table or other support surface.

According to an aspect of the present invention, a lift assist device for assisting a user in lifting an item includes a base having a center portion and a side portion that is angled relative to the center portion, a support shaft extending upward from the center portion of said base, and a support platform attached at an upper end of the support shaft. The lower end of the support shaft is attached at the center portion and the support platform is rotatably attached at the upper end of the support shaft and rotatable about an axis that is generally parallel to a longitudinal axis of the support shaft. The lift assist device is tiltable between a loading position, where the side portion of the base rests on a floor or support surface and the support shaft is in a tilted orientation, and a lifting position, where the center portion of the base rests on the floor or support surface and the support shaft is in a generally vertical orientation.

Optionally, the support shaft may be adjustable in length to adjust a height of the support platform relative to the base, and the support shaft may be manually adjustable or automatically adjustable responsive to the position of the lift assist device.

According to another aspect of the present invention, a method for lifting an article off of a support surface includes providing a lift assist device having a base, a support shaft and a support platform. The base has a center portion and a side portion that is angled relative to the center portion. The support shaft extends upward from the center portion of the base, and has a lower end attached at the center portion and an upper end opposite the lower end, and the support platform is attached at the upper end of the support shaft. The method includes tilting the lift assist device to a loading position, where the side portion of the base rests on a floor or support surface and the support shaft is in a tilted orientation, and lifting an end of an article onto the support platform when the lift assist device is in the loading position, whereby the lifted end of the article is supported by the support platform and an opposite end of the article is supported at the support surface. With the end of the article supported on the support platform, the lift assist device is tilted to a lifting position, where the center portion of the base rests on the floor or support surface and the support shaft is in a generally vertical orientation. The opposite end of the article is raised above the support surface when the lift assist device is tilted to the lifting position.

Therefore, the present invention provides a lift assist device and method of lifting articles that assists a user in lifting heavy objects or articles. The lift assist device is particularly suited for assisting a user in lifting heavy articles, such as large sheets of plywood or particle board or drywall or the like or elongated beams or the like, from a support surface or floor or ground up and onto an elevated target support surface or table, such as a workbench or work table or the like, where the user may process or work on the lifted article. The lift assist device provides the lifting function via the balanced configuration of the lift assist device and the leverage it provides when a portion of the object or article is supported on the lift assist device. A user of the lift assist device of the present invention thus may readily lift a portion of an article onto the lift assist device and then, using the lift assist device as a fulcrum and to provide the desired leverage, may readily raise the un-supported or opposite end portion of the article to a desired level or height to generally align the article with the elevated target support surface or table.

These and other objects, advantages, purposes and features of the present invention may be readily understood upon review of the following specification in conjunction with the drawings.

DETAILED DESCRIPTION OF THE PREFERRED EMBODIMENTS

Figure 1:
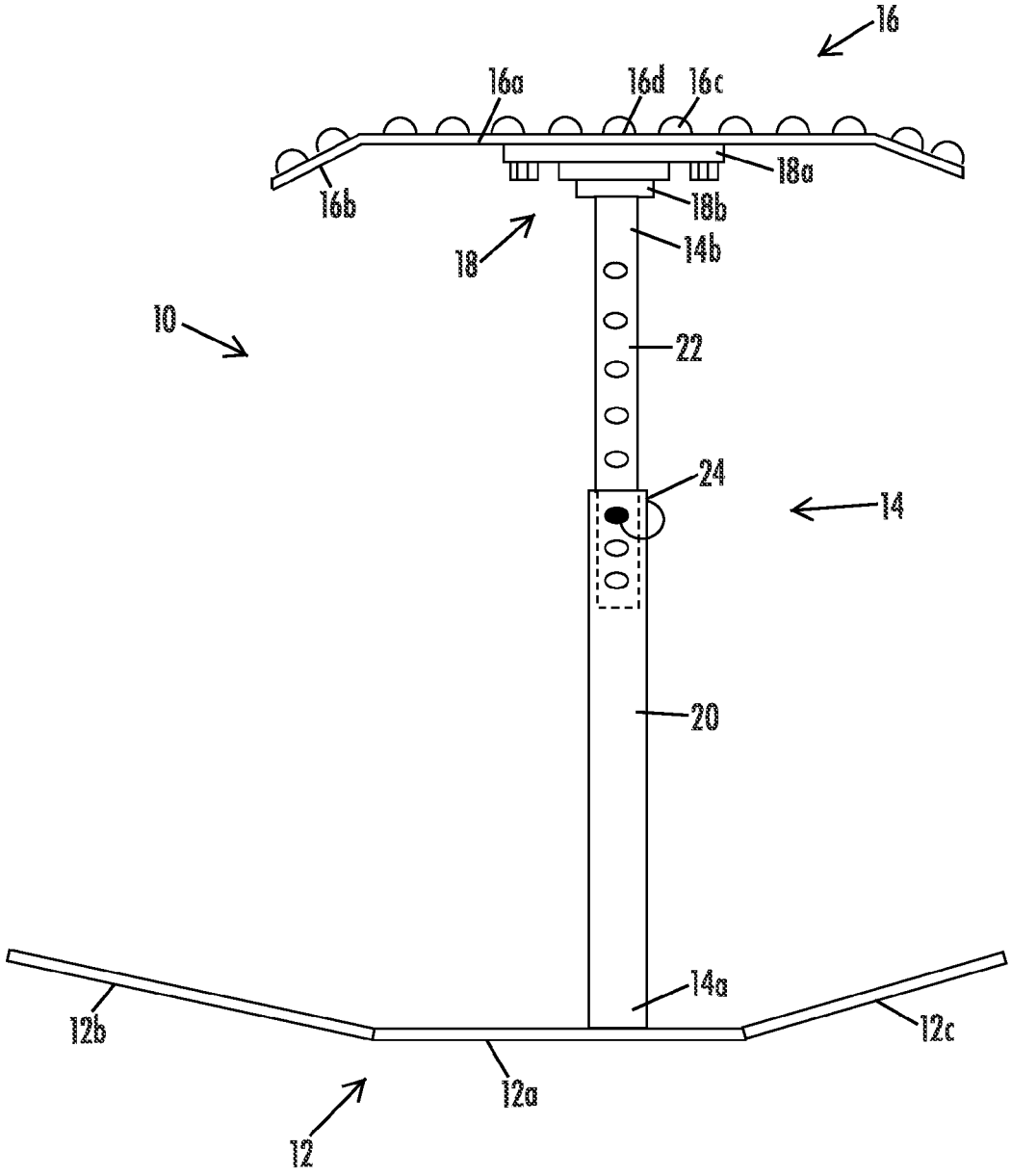
FIG. 1 is a side elevation of a lift assist device in accordance with the present invention, shown in its generally upright or vertical orientation.

Referring now to the drawings and the illustrative embodiments depicted therein, a lift assist device 10 includes a base or base portion 12, a support shaft or rod 14 with a lower end 14*a* attached to and extending upward from base 12, and a support platform 16 attached at an upper end 14*b* of support shaft 14. Base 12 includes a first or generally central portion 12*a*, from which support shaft 14 extends upwardly therefrom, and an angled or curved portion 12*b* that curves upwardly from the first base portion 12*a*, such that the lift assist device 10 can be tilted between a supporting or lifting position (FIG. 1), where the first or generally central base portion 12*a* rests on the ground or other generally horizontal support surface, with the support shaft 14 being generally vertically oriented and the support platform 16 being generally horizontally oriented, and a tilted or loading position (FIG. 2), where the lift assist device is tilted such that the angled base portion 12*b* rests on the support surface or ground, with the support shaft 14 being tilted or angled or non-vertical and the support platform being angled downward for receiving an end portion of an article thereon, as discussed below. Optionally, and desirably, support platform 16 is rotatably mounted to or attached at the upper end of support shaft 14 (such as via a rotatable element or bracket 18 or the like) to facilitate movement or pivoting of the article supported on the lift assist device 10 when the lift assist device 10 is in its lifting or generally vertical orientation, as also discussed below.

In the illustrated embodiment, support platform 16 comprises a generally planar platform portion 16*a*, with downwardly angled or curved side regions or portions 16*b*. The downwardly angled support platform portion 16*b* may allow the operator to begin the loading process of the lift assist device when the lift assist device is in its non-tilted orientation, such that when the end portion of the article is raised onto the support platform, the article may contact one of the downward extending lifts 16*b* and may cause the lift assist device to move or pivot or tilt toward its tilted orientation (FIG. 2) to assist in the loading process discussed below. Support platform 16 may comprise any suitable material, and may, for example, comprise a metallic ridged material with a non-slip coating or surface or element disposed at its upper surface. In the illustrated embodiment, the support platform 16 includes a rubber layer or element 16*c* having a plurality of raised bumps or protrusions 16*d* that engage and support the article at the support platform 16 and limit slippage of the article on the support platform 16 during use of lift assist device 10.

Figure 2:
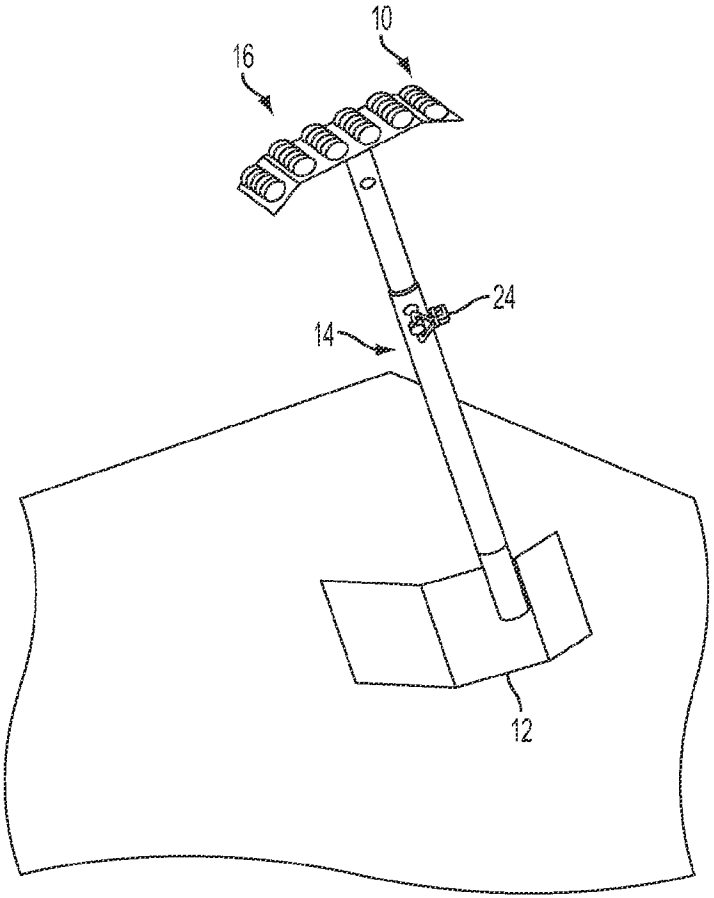
FIG. 2 is a perspective view of the lift assist device of FIG. 1, shown in its tilted or loading orientation.

As can be seen in FIG. 1, support platform 16 is rotatably mounted at the upper end 14*a* of support shaft 14, such as via rotating mounting bracket 18, which allows for substantially free rotation between an upper bracket element 18*a* attached at the lower surface of the support platform 16 and a lower bracket portion 18*b* attached at the upper end 14*a* of support shaft 14. The rotating bracket 18 may comprise any suitable means for allowing for such rotation of the support platform relative to the support shaft, including, for example, ball bearings or slide surfaces or the like. The rotating bracket provides for pivotal or rotational movement of the support platform 16 relative to the base 12, and may be disposed between the support platform and the support shaft or elsewhere on the lift assist device, such as along the support shaft or between the support shaft and the base, while remaining within the spirit and scope of the present invention.

Support shaft 14 may comprise any elongated shaft or rod, with its lower end 14*a* attached at the central base portion 12*a* of base 12, and with its upper end 14*b* attached at support platform 16 (or at rotating bracket 18). In the illustrated embodiment, support shaft 14 comprises a telescoping shaft having a hollow lower shaft portion 20 and an upper shaft portion 22 slidably or adjustably received in an upper end portion of lower shaft portion 20. As best shown in FIG. 1, lower shaft portion 20 includes a passageway or hole 20*b* established therethrough, while upper shaft portion 22 includes a plurality of holes or passageways 22*a* established therethrough, whereby the upper shaft portion may be positioned at a desired height or degree of extension relative to lower shaft portion 20, and a pin 24 may be inserted through the corresponding or aligned holes or passageways to substantially lock the support shaft at the desired length or degree of extension. The upper end 14*b* of the support shaft 14 may be attached or secured to the support platform or rotating bracket via any suitable means, such as welding or clamping or bolting or otherwise securing the upper end 14*b* to the support platform 16 or rotating bracket 18. Likewise, the lower end 14*a* of support shaft 14 may be attached or secured to the central base portion 12*a* of base 12 via any suitable means, such as welding or clamping or bolting or otherwise securing the lower end 14*a* of support shaft 14 to base 12.

Figure 3:
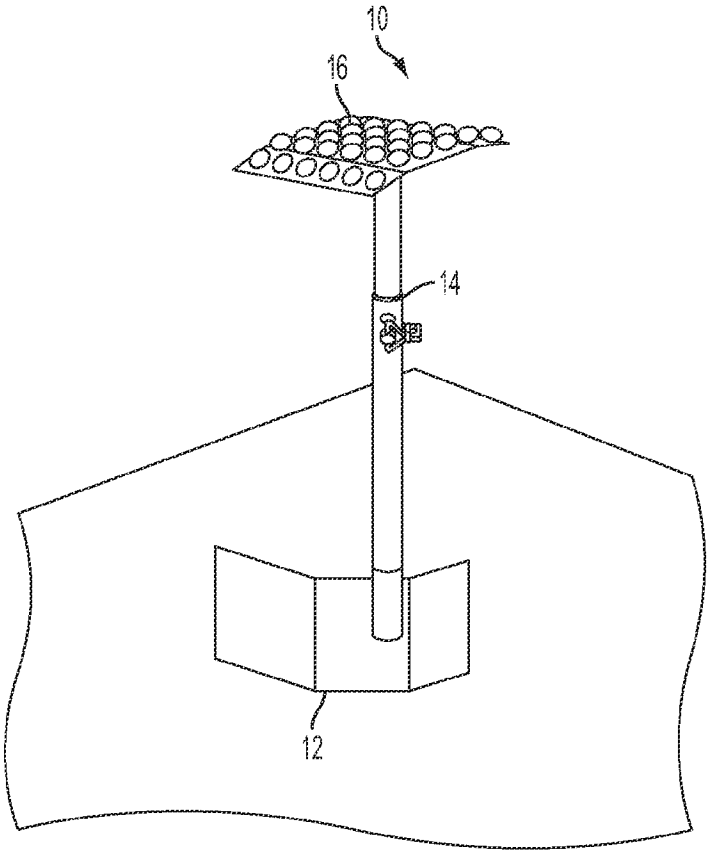
FIG. 3 is a perspective view of the lift assist device of FIGS. 1 and 2, shown in its generally upright orientation.
Figure 2A:
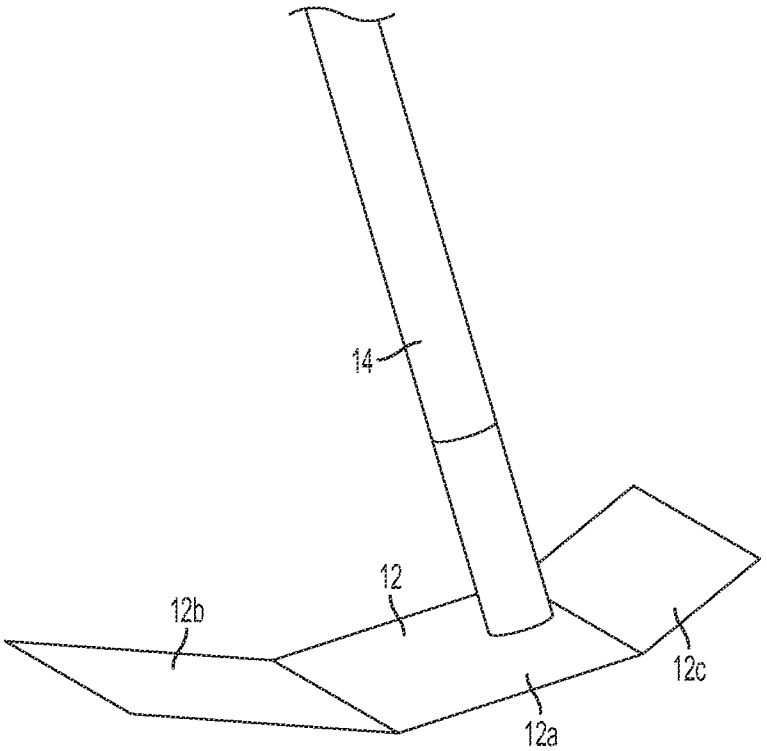
FIG. 2A is a perspective view of a lower portion of the lift assist device of FIGS. 1 and 2.

Base 12 may comprise any suitable material, such as a metal plate or the like, and may be formed such that the angle or curved base portion 12*b* angles or curves upwardly from the central or support shaft mounting portion 12*a* to allow the base 12 to tilt from its untitled position (FIG. 1), where the central base portion 12*a* rests on the support surface or floor, and a tilted or angled orientation (FIGS. 2 and 2A), where the angled base portion 12*b* rests on the support surface or floor. Optionally, the base 12 may include a second angled portion 12*c* at the opposite side of the angled base portion 12*b*, to facilitate tilting of the lift assist device 10 in the opposite direction than the loading direction shown in FIGS. 2 and 3, such as to facilitate further raising of the non-supported or distal end of the article via tilting of the lift assist device to raise the non-supported end of the article to a desired height for loading the article onto a table or the like. The angled base portions 12*b*, 12*c* thus allow for control tilting of the lift assist device to allow for loading an article onto the lift assist device and raising of the article supported by the lift assist device in a controlled manner, while limiting tipping of the lift assist device. Optionally, although shown as having a generally central base portion and opposite angled portions, the base of the lift assist device may be otherwise curved or formed to allow for the desired degree of tilting and stability during such tilting, while remaining within the spirit and scope of the present invention.

As shown in FIG. 1, the support shaft 14 extends from the base portion 12*a* at or near a side region of the base portion 12*a*, with the angled base portion 12*b* being angled upward from an opposite or distal end of the base portion 12*a* from the support shaft 14. This configuration enhances the balancing of the lift assist device when in its non-tilted orientation (FIG. 1), and enhances the user's ability to tilt the lift assist device back to the non-tilted position after a heavy article has been loaded onto the support platform when the lift assist device is in its tilted position.

Thus, during use, a user of the lift assist device 10 may first set the degree of extension of a support shaft 14 to a desired amount (such as by setting the height of the support platform 16 at or near the height of a targeted support surface or cable or the like at which the article is to be placed). When the desired height of the lift assist device has been set, the user may tilt the lift assist device so that it is supported on the angled base portion 12*b*, and may then manually lift an end or portion of the article (such as a large sheet of plywood or particle board or drywall or the like, or such as an elongated beam or the like) and may place the end or portion of the article on the support platform 16. The user may place the portion of the article on the support platform, such that the end of the lifted portion of the article extends beyond the support platform, whereby the user may push downward on that end portion of the article while pulling back on the lift assist device, in order to pivot the lift assist device toward its supporting position (FIG. 1). The configuration and balancing of the lift assist device with the article supported thereon provides the desired leverage to assist the user in relatively easily raising the article above the ground with its free or distal end raised for aligning with the elevated target surface, such as a table or workbench or the like.

When the lift assist device is in its supporting position of FIG. 1, the non-supported distal end of the article (the portion that was not lifted by the user and was thus resting on the ground or support surface when the lift assist device was in its tilted or loading orientation) may be moved to be at or over or on the targeted support surface or table, such as via rotating the support platform and article support thereon relative to the base 12 and support shaft 14 via the rotating bracket 18. Thus, a single operator or user may readily lift an article (that may otherwise be too heavy or bulky for one person to lift) onto a raised or elevated support surface or table, such as for cutting or otherwise processing or working the article at the support surface or table. After the end portion of the article is supported at the support surface or table, the operator may slide or otherwise move rest of the article onto the support surface or table, or may leave that end portion of the article resting on the lift assist device, depending on the desired further processing or working of the article that is to be done at the support surface or table. If, when the lift assist device is tilted toward its vertical orientation shown in FIG. 1, the article is not raised enough to be able to be swung or pivoted onto the starting support surface or table, the user may pull back further on the lift assist device, such that the lift assist device tilts so at to be supported by the second angled portion 12*c* at the ground or support surface, whereby the distal end of the article supported on the support platform 16 is raised further, whereby the user may rotate the support platform and article to move the distal end of the article onto the targeted support surface or table.

Optionally, although shown as having slippage limiting rubber protrusions 16*c* spaced over the upper surface of the support platform, other support surfaces may be implemented while remaining in the spirit and scope of the present invention. For example, other rubber coatings or elements may be disposed at the upper surface of the support platform to assist in limiting slippage of the article relative to the support platform during use of the lift assist device. Optionally, however, the support platform may provide movement enhancing means to assist in moving or sliding the article back onto the support platform and off of the support platform and onto the targeted support surface or table. For example, the support platform may include a plurality of rollers or the like that facilitate rolling of the article in one or more directions on the support platform to ease the operator's efforts in loading and unloading the support platform. It is envisioned that such rollers may comprise rotatable balls that allow for multidirectional movement of the article on the support platform, and it is envisioned that such rollers or balls may be selectively lockable to allow for selective movement of the article and selective non-movement of the article to provide enhanced control of the movement and loading/unloading of the article by the user of the lift assist device.

Also, although shown as having a telescoping support shaft that is adjustable to provide varying heights or degrees of lift of the lift assist device, other types of support shafts may be implemented, while remaining in the spirit and scope of the present invention. For example, the support shaft may have a fixed length, whereby the lift assist device is not vertically adjustable and may lift the article to desired or various heights by tilting the lift assist device back toward and onto the second angled portion 12*c* of the base 12. Optionally, other types of adjustable support shafts may be implemented, such as a manually hand-crank type of support shaft (whereby the user may turn a crank to cause extension or retraction of one shaft portion relative to another) or any other suitable means for extending and retracting the support shaft to raise and lower the height support platform relative to the base.

Optionally, it is envisioned that the lift assist device may be vertically adjustable when the end portion of the article is loaded onto and support by the lift assist device. For example, after the end portion of article is loaded onto support platform and the lift assist device it tilted toward its non-tilted position, the user may selectively adjust the height of the support platform (or the lift assist device may automatically adjust the height of the support platform) to raise the support platform and article partially supported thereon to a desired level. Such a configuration allows for loading of the article onto a lower or unraised support platform, where further lifting of the article to the desired height (so as to generally align the article with the height of the elevated targeted support surface or table) is done by the lift assist device and not by the user or operator. Such vertical adjusting of the lift assist device when loaded may be done any via suitable adjusting means, such as via a manual hand-crank or the like that the operator may turn or actuate to raise or lower the support platform the desired amount, or such as via a power assist system or mechanism or device, which may automatically raise the support platform or article to a desired level or height responsive to a user input or other triggering device or event.

For example, and with reference to FIGS. 4-10, a lift assist device 110 includes a base 112, an extendable and retractable support shaft 114, and support platform 116, with an actuator or actuating mechanism 130 that is operable to extend and retract support shaft 114 to raise and lower support platform 116 relative to base 112. Base 112 and support platform 116 may be substantially similar to base 12 and support platform 16, discussed above, such that a detailed discussion of these components of the lift assist devices need not be repeated herein.

Figure 6:
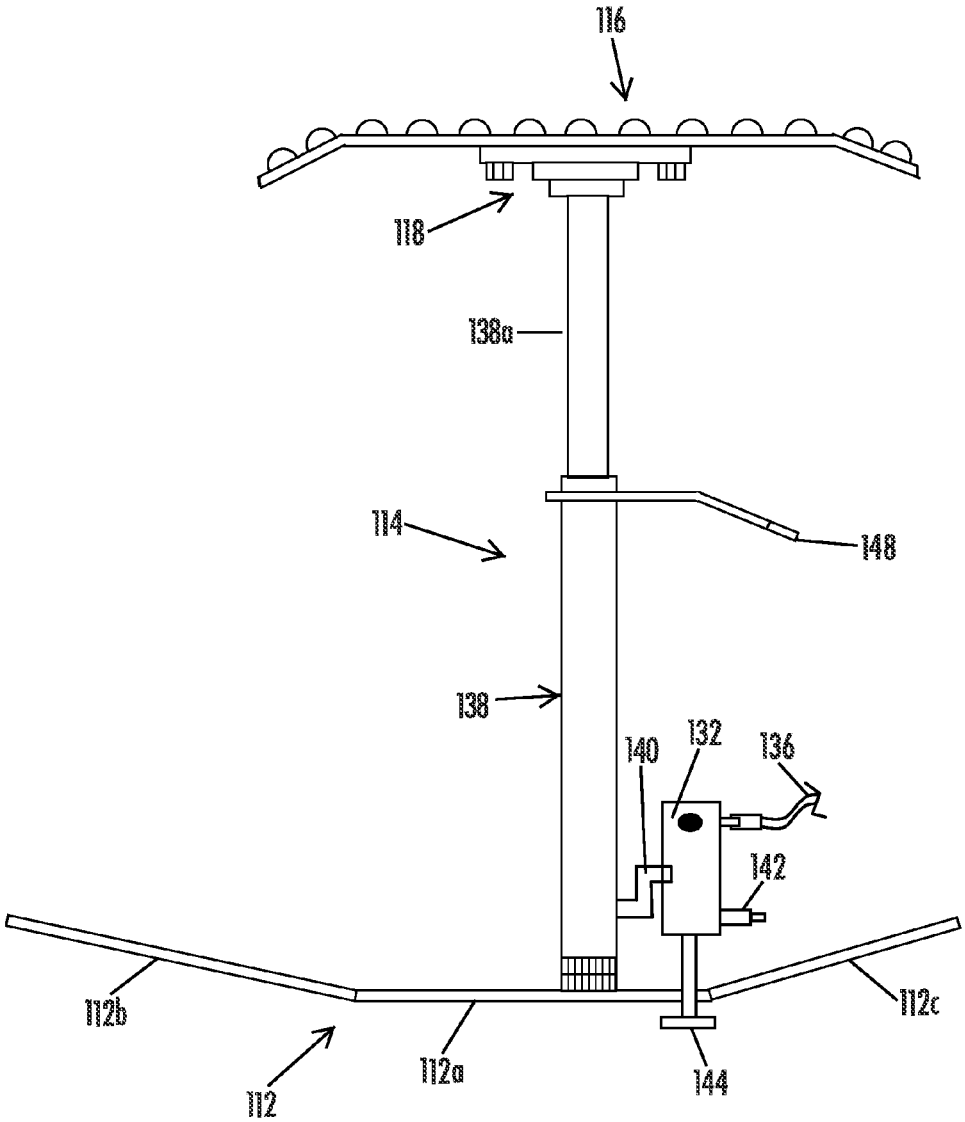
FIG. 6 is a side elevation of the list assist device of FIGS. 4 and 5, shown in a generally vertical orientation with the support platform being at least partially raised.

In the illustrated embodiment, the actuator or actuating device or mechanism 130 comprise a pneumatic actuating device, which includes a control valve 132 that is connected to a pressurized air source 134 (such as via an air supply line 136 or the like) and is selectively operable to pressurize a pneumatic actuator or cylinder 138 to cause extension of a piston and rod 138*a* of the pneumatic cylinder 138 and support shaft 114. As best shown in FIG. 6, control valve 132 is connected to the pressurized air source 134 (such as an air compressor or pressurized air tank or the like) via a pneumatic supply hose or line 136, and is connected to the pneumatic cylinder 138 via a connecting air line 140. Control valve 132 also includes a relief valve or port 142, and includes a switch or input device 144.

Figure 10:
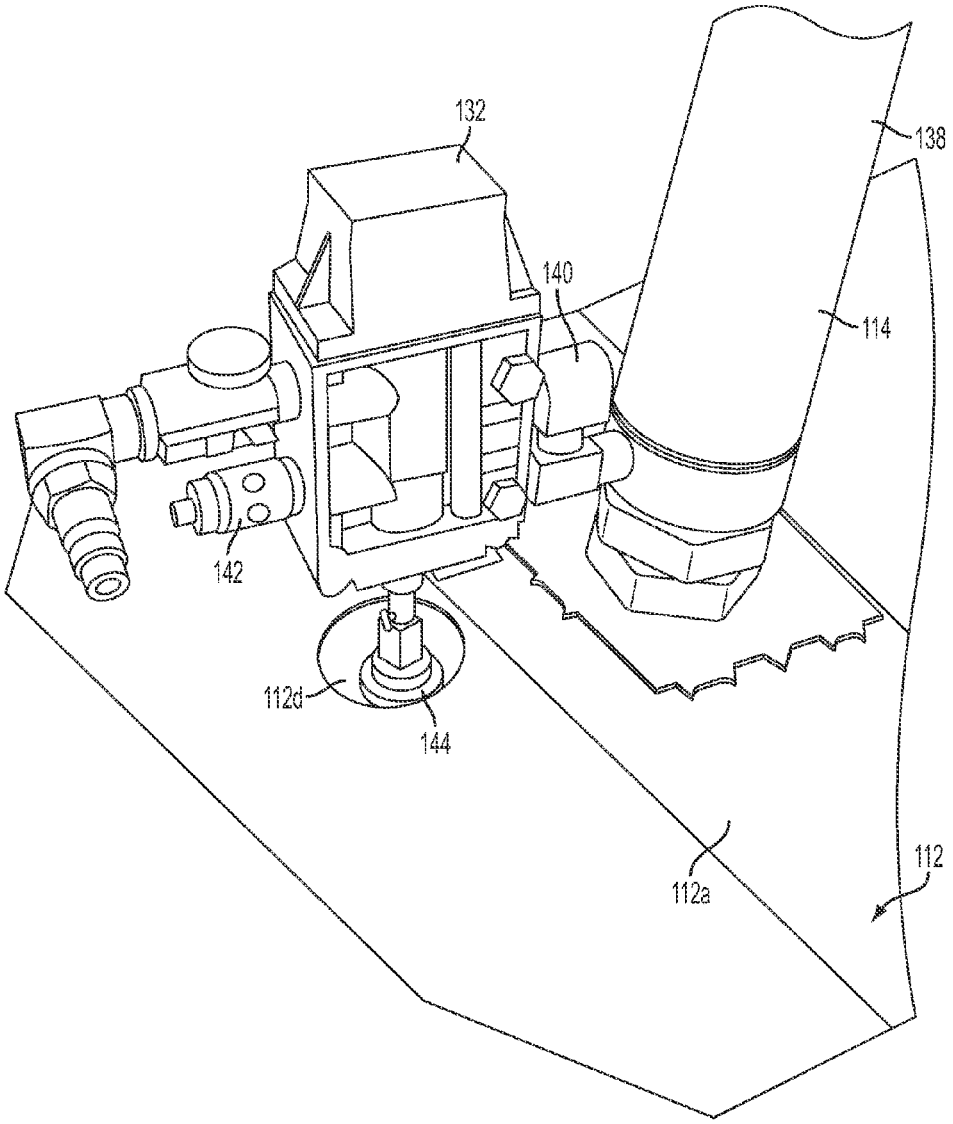
FIG. 10 is an enlarged perspective view of the base of the lift assist device of FIGS. 4-8, shown with a pneumatic control valve and switch for actuating the actuator of the lift assist device to raise and lower the support platform relative to the base.

Actuation of the switch 144 (such as via depressing the switch toward the control valve 132 as discussed below) causes the control valve 132 to allow for passage of pressurized air from the air source 134 to the lower or input end of the pneumatic cylinder 138, thereby moving the piston and rod 138*a* along the pneumatic cylinder 138 to raise the support platform 116 relative to base 112. Optionally, and desirably, when the switch 144 is no longer depressed, and moves away from the control valve 132, the control valve 132 may vent the pressurized air in the air cylinder 138 via the relief port 142 to cause or allow retraction of the piston rod 138*a* back into the pneumatic cylinder 138, thereby lowering the support platform 116 relative to the plate 112. As best shown in FIG. 10, the control valve 132 is mounted at the lower end 114*a* of support shaft 114 (which comprises a pneumatic cylinder 138), and switch 144 extends downwardly from the control valve 132 and is aligned with and extends at least partially through an aperture or hole 112*d* formed in the base plate 112 (such as in the central base portion 112*a* or such as at or near or in the second angled portion 112*c*).

Figure 4:
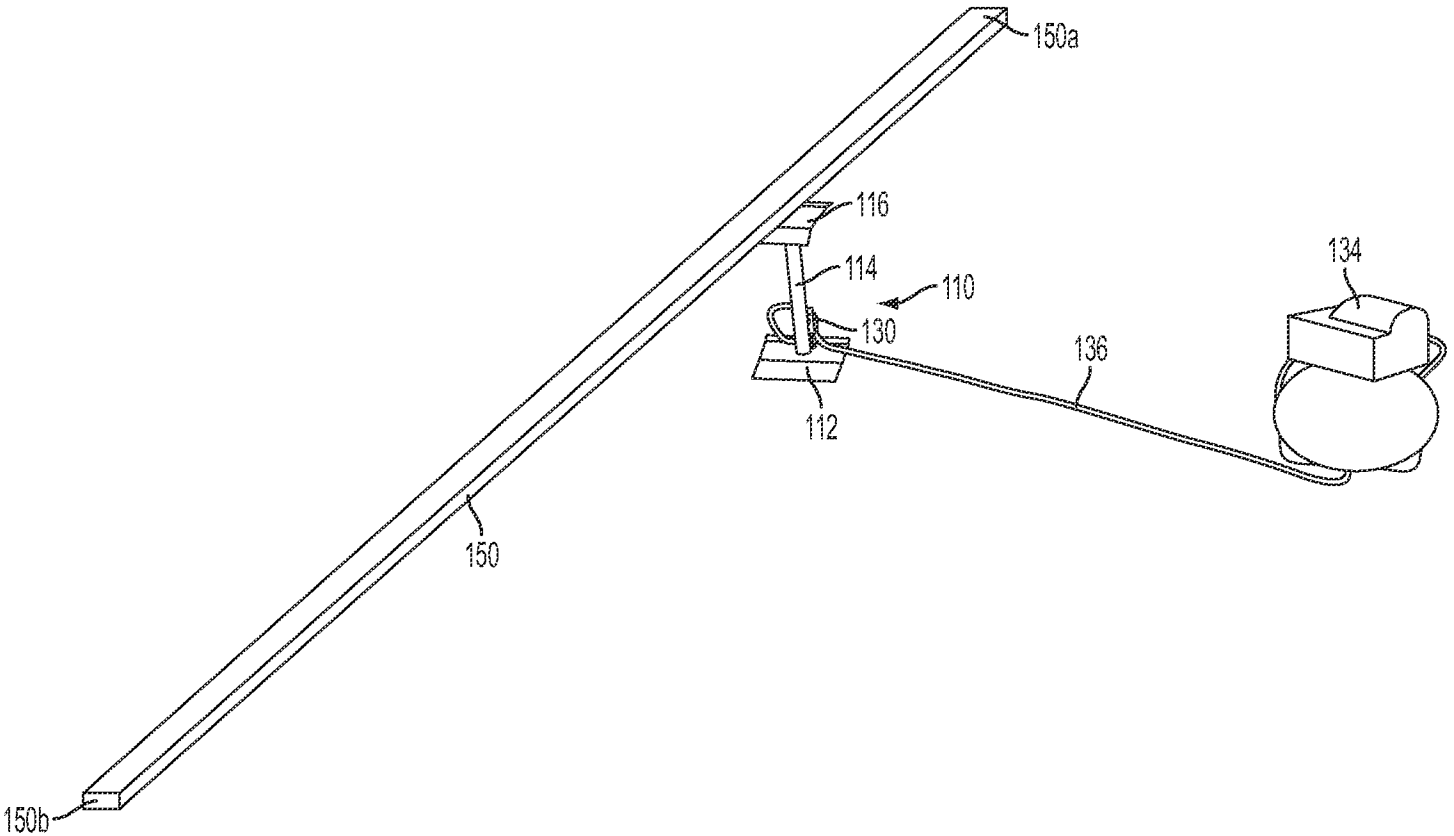
FIG. 4 is a perspective view of another lift assist device in accordance with the present invention, shown in a lowered and tilted or loading orientation with an end portion of a beam supported thereon.
Figure 5:
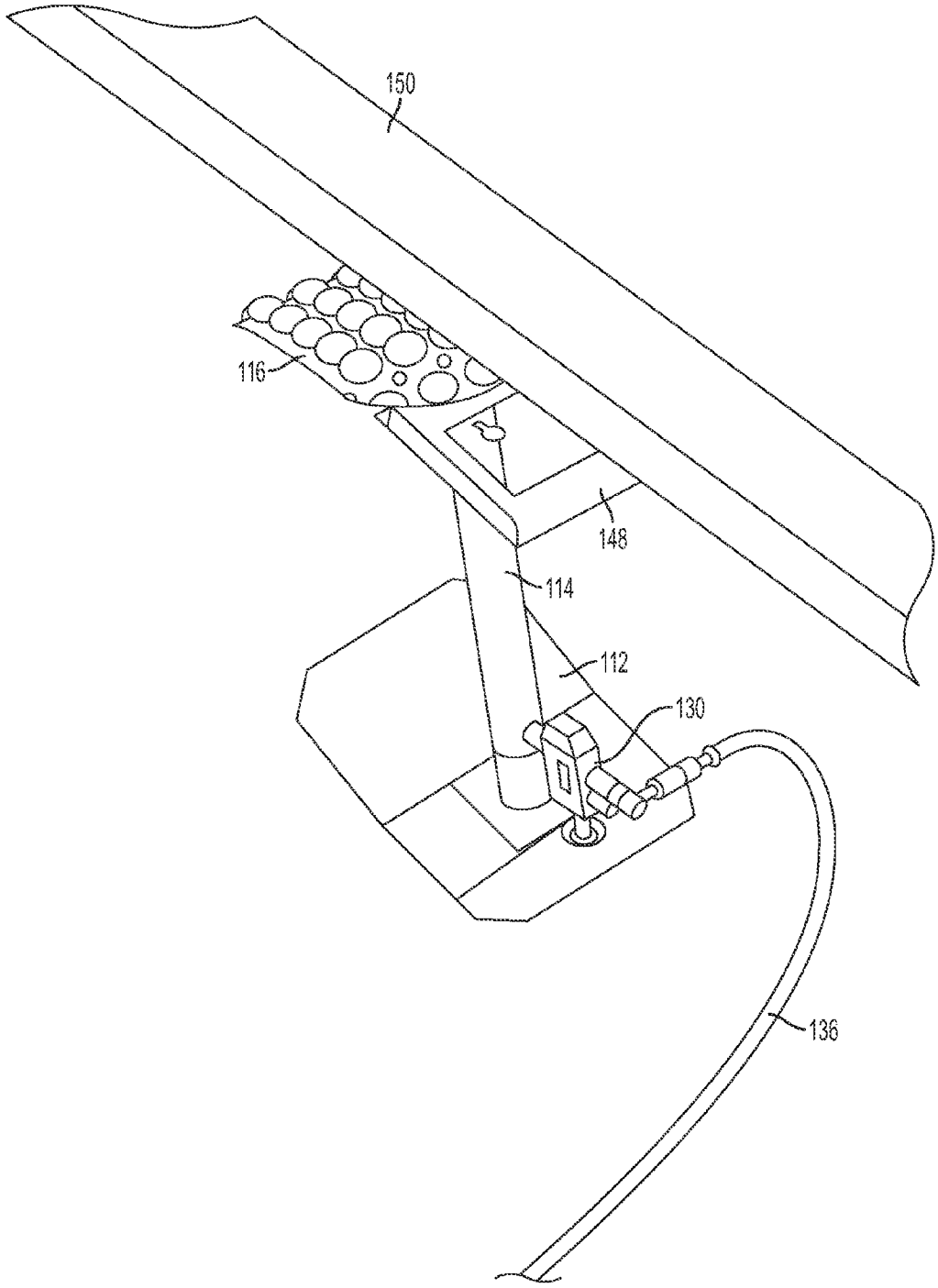
FIG. 5 is another perspective view of the lift assist device of FIG. 4.
Figure 7:
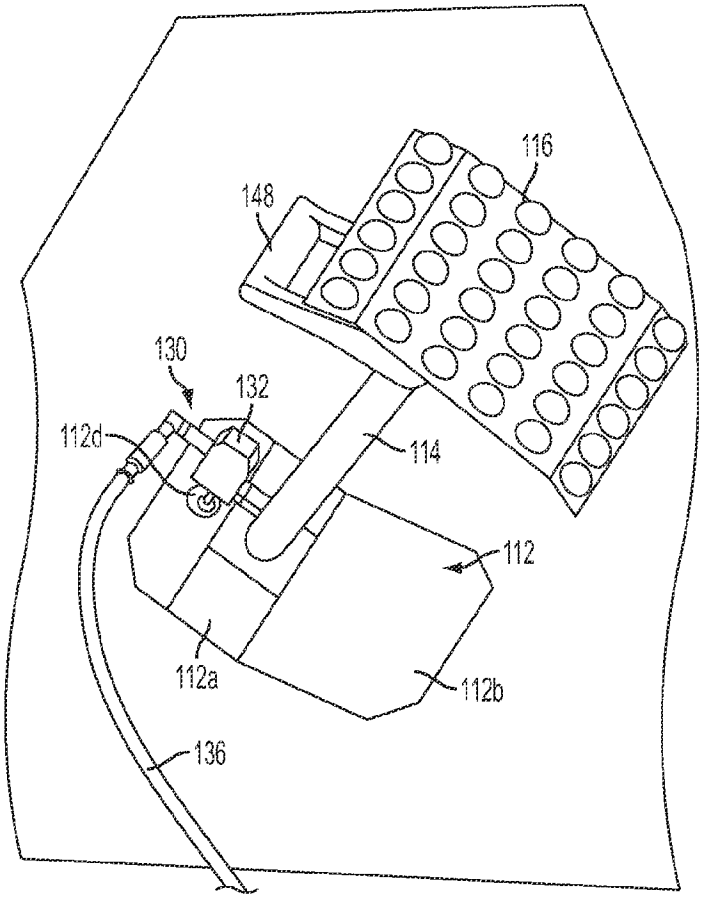
FIG. 7 is another perspective view of the lift assist device of FIGS. 4-6, shown in its tilted or loading orientation with the support platform in a lowered position.

Thus, during use of powered lift assist device 110, a user may initially tilt the lift assist device to its tilted or loading position (such as shown in FIGS. 4, 5 and 7), with its actuator or cylinder or support shaft in the retracted state. The user may then lift an end portion 150*a* of an article 150 (such as an elongated beam as shown in FIGS. 4 and 5), and may rest the beam 150 on the support platform 116, with the lifted end 150*a* extending beyond the lift assist device, and with the opposite or distal end 150*b* resting on the ground or support surface at which the lift assist device 110 is disposed. When the lift assist device 110 is tilted in this manner, the switch 144 extends through the aperture 112*d* and base 112 and is in its "off" position, such that pressurized air is not provided to the pneumatic cylinder and the pneumatic cylinder thus remains in its retracted position, with a portion of the weight of the beam on the support platform 116 at the upper end of the support shaft 114 and pneumatic cylinder 138.

The user may then push down on the end 150*a* of the beam 150 and/or may pull back on the lift assist device 110 (such as via pulling at a handle 148 of the lift assist device 110 toward the raised end 150*a* of the beam 150 and away from the distal and non-lifted end 150*b* of the beam). As the lift assist device is pivoted toward its upright or lifting position (FIGS. 6 and 9), the distal end 150*b* of the beam 150 is raised above the ground, such as in a similar manner as discussed above with lift assist device 10. Also, as the lift assist device 110 is pivoted to its upright or lifting position, switch 144 is depressed into and toward the control valve 132, and, when depressed a sufficient amount (such as when the lift assist device is tilted to its generally upright orientation with the support shaft being generally vertical), switch 144 actuates control valve 132 to allow for pressurized air to flow through control valve 132 and into the pneumatic cylinder 138 to cause extension of the support shaft 114 to raise the article or beam 150 to the desired or selected or preset height or level. Thus, the automatic or powered lift assist device 110 operates in a similar manner as the manual or non-powered or mechanical lift assist device 10, discussed above, until the lift assist device is positioned at its upright position with a load support thereon. At that time, the actuator 130 may automatically operate (responsive to the switch 144) to raise the support platform and article supported thereon to the desired or predetermined height. The raised height or stroke length of the lift assist device may be determined by the size of the actuator or cylinder or may be preset or preselected and controlled to a selected or appropriate height (such as via a mechanical stop or pressure limit switch or air flow control or the like), such that the article is raised an appropriate or desired or selected amount for the particular application or use of the lift assist device (such as to position the lifted article at a desired height for moving the article onto a work surface or table or the like).

After the article or beam is aligned with the targeted support surface or table and moved or unloaded from the lift assist device, the user may tilt the lift assist device in either direction to allow for extension of the switch from the control valve to cause the control valve to no longer supply pressurized air to the pneumatic cylinder 138, but instead to vent the pressurized air from the pneumatic cylinder 138 through the relief port or vent 142, thereby allowing the support shaft to retract to lower the support platform back to its lowered position.

Figure 8:
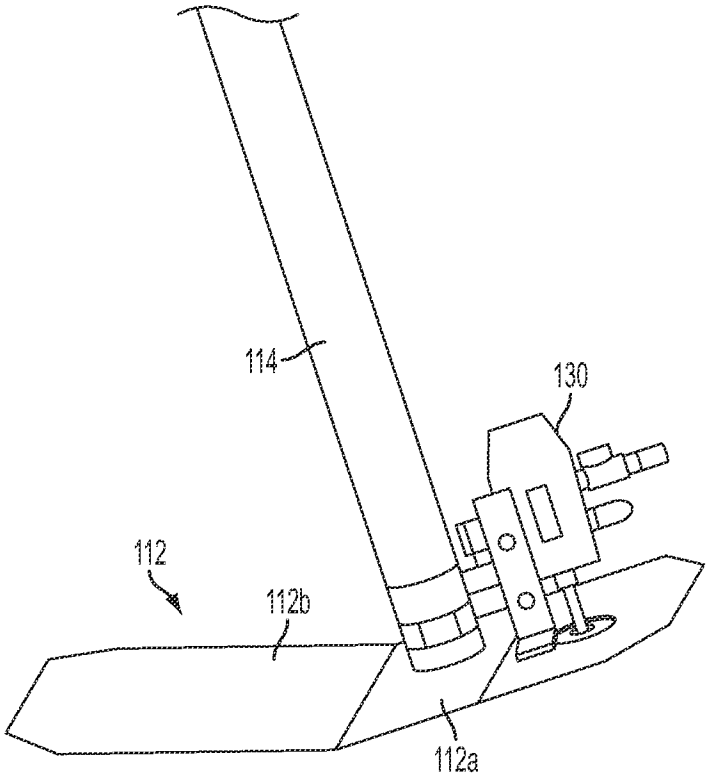
FIG. 8 is a perspective view of the base of the lift assist device of FIGS. 4-7, showing the base tilted to tilt the lift assist device to its tilted or loading orientation.

Optionally, and as shown in FIG. 6, the switch 144 may be positioned through a hole in the generally central base portion 112*a*, such that the control valve 132 and pneumatic 138 are actuated to extend the support shaft 114 when the lift assist device is moved to its generally vertically orientation as shown in FIG. 6. Optionally, and such as shown in FIGS. 8 and 10, the switch 144 may be disposed at and through the second angled portion 112*c* of the base 112, whereby the switch is not fully depressed to actuate the control valve 132 until the user pulls further back on the handle 148 to tilt the lift assist device further and past its generally upright position.

Optionally, a switch cover or membrane or plate (such as a spring steel plate or flexible plastic or rubber plate or cover or the like) may be disposed at the base and generally at the hole (such as at the bottom or lower surface of base portion 112*c* of the base 112), in order to allow or enhance the switch to properly function on soft ground or materials, such as when the lift assist device is used in grass or dirt or gravel or the like. The flexible cover or membrane thus limits the extension of the switch and, when depressed, actuates the switch, and the flexible cover provides a greater surface area at the switch-to-ground interface, thereby enhancing performance of the switch when the lift assist device is used on soft ground (and limiting the possibility of the switch extending into the soft ground when the lift assist device is tilted past its upright position). Optionally, the flexible cover or membrane may be enlarged and the hole in the plate may be enlarged to provide a greater surface area interface for the switch, depending on the particular application of the lift assist device.

Optionally, the lift assist device may include a pedal or foot actuator or element that allows the user to depress or step down on or at the second angled portion of the base to assist in pivoting the lift assist device from its loading position to its support or lifting or raising position, such as when an object or article is supported at the support platform. For example, and with reference to FIGS. 11 and 12, the lift assist device 110 may include a foot pedal 150 that extends outward from the second angled portion 112*c* of base 112, and provides an extension for a user to press down on with his or her foot to tilt the lift assist device 110 towards its lifting or raising position and to tilt it past the lifting or raising position so that the second angled portion 112*c* is tilted towards the ground.

The foot pedal 150 provides enhanced control of the tilting of the lift assist device and allows the user to use both hands to hold and steady the article supported on the support platform 116 (particularly for lightweight articles or sheets of plywood or the like that may otherwise slide off of the support platform when the user pulls back on the handle 148 to tilt the lift assist device to its upright or lifting position). The foot pedal 150 may also provide added leverage to assist the user in tilting the lift assist device (with an article supported thereat) from the loading position to the lifting or support position, and may provide enhanced control of actuating the switch 144 to actuate or control the control valve 132 during use and operation of the lift assist device. The foot pedal 150 may comprise an extension of the angled base portion 112*c* or may comprise a separate attachment or pedal bolted or otherwise attached to the angled base portion 112*c*, and the foot pedal 150 may extend generally parallel to the angled base portion 112*c* or may be bent or angled relative to the angled base portion to provide an angled surface that the user may more readily place their foot on during use and operation of the lift assist device.

Figure 11:
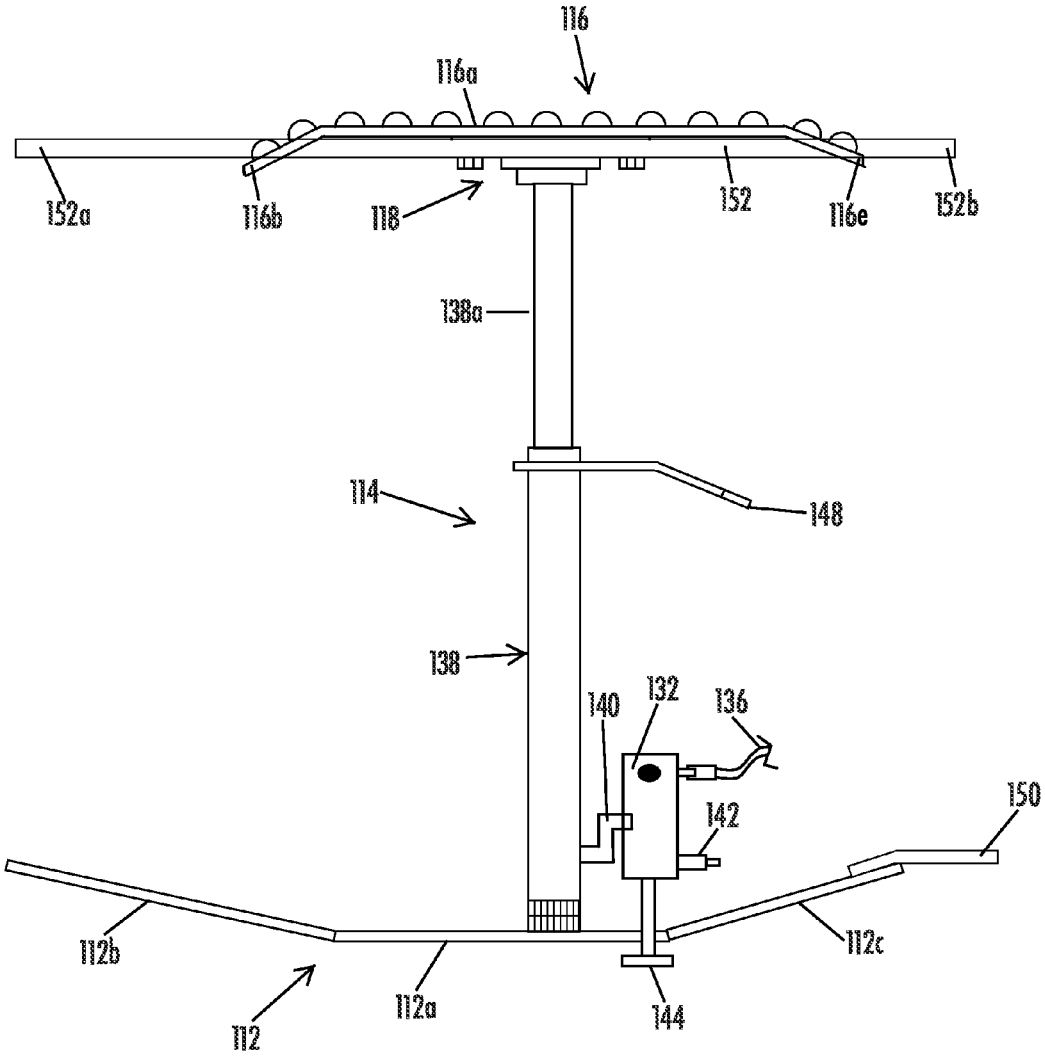
FIG. 11 is a side elevation of the lift assist device of FIGS. 4-7, shown with elongated support rods attached thereto.
Figure 12:
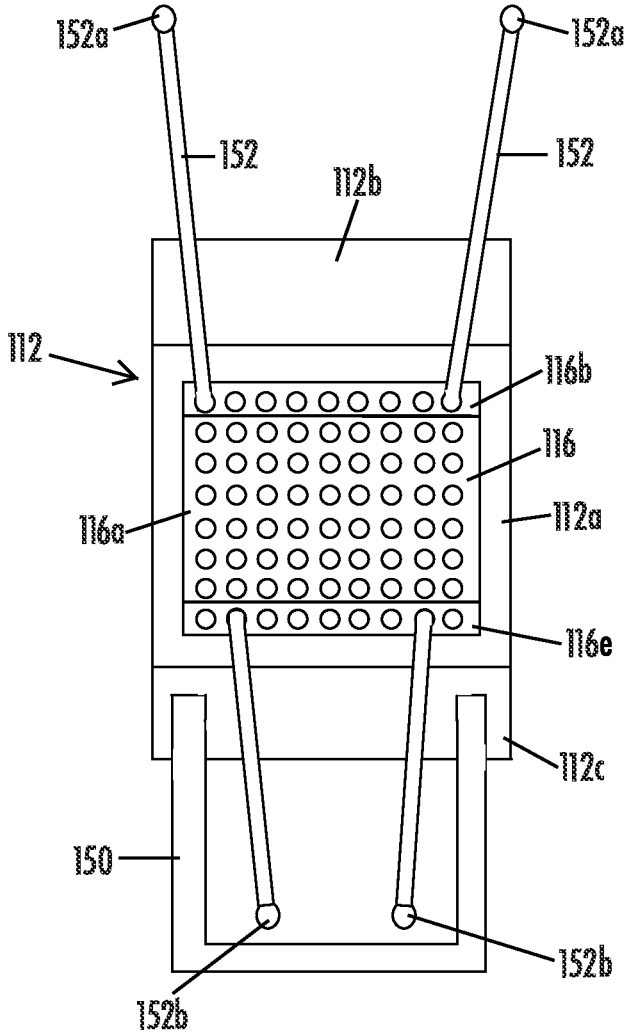
FIG. 12 is a top plan view of the lift assist device of FIG. 11.

Optionally, the lift assist device of the present invention may include a larger support platform or may include extension supports (such as elongated rods or beams or brackets) that extend from the support platform generally in the direction of tilting to assist in supporting larger items or articles, such as large sheets of plywood or the like. For example, and again with reference to FIGS. 11 and 12, the lift assist device 110 may include a pair of elongated support rods or bars or brackets or extensions or elements 152 that extend in opposite directions from the support platform 116 to provide a longer or larger supporting structure at the upper end of the lift assist device. As shown in FIGS. 11 and 12, the support rods 152 may be inserted or received through the downwardly angled portions 116*b*, 116*e* of support platform 116 so as to be disposed below the main or primary or generally planar platform portion 116*a* and extending in opposite directions therefrom. The support rods 152 extend generally in the direction of tilting (with the ends 152*a* of the rods 152 extending generally towards the ground when the lift assist device 110 is in its loading position and the other ends 152*b* of the rods 152 extending generally away from the ground when the lift assist device 110 is in its loading position) to provide support for an elongated article to be lifted by the lift assist device. As shown in FIG. 12, the support rods 152 may diverge away from one another towards ends 152*a* to provide broader or wider support at or towards the ground when the lift assist device 110 is in its loading position.

The support rods provide additional support for an article being lifted by the lift assist device, such as a large, lightweight sheet of plywood or laminate or the like (which may be flexible or non-rigid). For example, the support rods may provide enhanced support for large sheets (such as a four by twelve sheet of plywood or laminate or the like) that may otherwise bend or flex during lifting so that they are difficult to lift and load onto a raised surface or table. The support rods provide support to the lifted end of the article and allow for a generally flat or non-flexed or non-bent end of the article that can then be readily guided onto the elevated support surface or table when the lift assist device is raised to the desired or targeted elevation.

Although shown and described as a pneumatic actuator or actuating device or mechanism or system that is operable responsive to a switch at the base plate 112, clearly other means for selectively extending and retracting the support shaft to raise and lower the support platform and article supported thereon may be implemented while remaining within the spirit and scope of the present invention. For example, the actuator or actuating device or extension/retraction mechanism may comprise any suitable actuating means, such as a hydraulic actuator or cylinder (such as a single action hydraulic cylinder or a double action hydraulic cylinder or the like) or any other linear actuator device or the like. Optionally, actuation or control of the extending/retracting actuator may be performed via any suitable means, such as a switch of the type shown and described above (that automatically actuates the actuator responsive to the tilting of the lift assist device during use), or a switch or user input or inputs at the handle 148 or the like, where a user may selectively control the raising and lowering of the support platform during use of the lift assist device via actuation of an appropriate user input or switch or button.

Thus, the present invention provides for a lift assist device that facilitates relatively easy lifting and moving of heavy objects by a single person, with substantially reduced efforts required by the person and with the person never having to lift the entire article or object by himself or herself. The lift assist device, and the base plate and support platform, are substantially balanced to allow for relatively easy tilting and stabilizing of the lift assist device at its tilted orientation, and the configuration of the lift assist device provides the appropriate leverage to facilitate and enhance the tilting back of the lift assist device to its generally upright or lifting orientation, and thus to enhance the raising of the distal end of the article supported by the lift assist device, whereby the article may be readily held and maintained at its lifted state.

Figure 9:
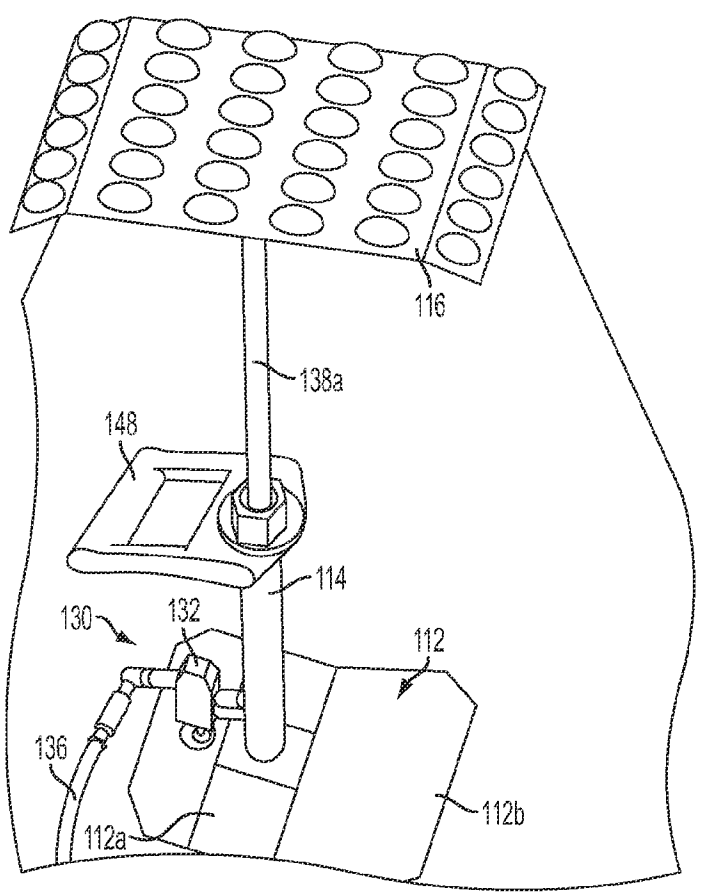
FIG. 9 is another perspective view of the lift assist device of FIGS. 4-7, shown with the support platform in a raised position.

In the illustrated embodiment, the support shaft is mounted to the central or bottom base portion of the base plate and is off-center relative to the base plate, while the support platform may also be mounted off center on the support shaft (such as can be seen with reference to FIGS. 7 and 9). When the lift assist device is in its lifting or upright position, and the article is supported by the lift assist device, the user may readily pivot or rotate the article and support platform to align the distal end of the article with the targeted support surface or table for loading or moving the article onto the targeted support surface or table (and optionally first raising the height of the support platform via an actuator or the like). Further tilting of the lift assist device beyond its generally vertical or lifting orientation functions to further lift the distal end of the article to assist in aligning the end of the article with the targeted support surface or table or the like. The user of the lift assist device thus may lift a substantially heavy article, such as a large piece of plywood or particle board or drywall or the like or a large or elongated metal or wood beam or the like, onto an elevated targeted support surface or table for processing (such as cutting or sanding or painting or otherwise working) the article at the support surface or table or work surface.

Changes and modifications to the specifically described embodiments may be carried out without departing from the principles of the present invention, which is intended to be limited only by the scope of the appended claims, as interpreted according to the principles of patent law.

The invention claimed is:

1. A lift assist device for assisting a user in lifting an item, said lift assist device comprising:

a base having a center portion and a side portion that is angled relative to said center portion;

a support shaft extending upward from said center portion of said base, said support shaft having a lower end attached at said center portion and an upper end opposite said lower end;

a support platform attached at said upper end of said support shaft and rotatable about an axis that is generally parallel to a longitudinal axis of said support shaft;

wherein said lift assist device is tiltable between a loading position, where said side portion of said base rests on a floor or support surface and said support shaft is in a tilted orientation, and a lifting position, where said center portion of said base rests on the floor or support surface and said support shaft is in a generally vertical orientation and wherein said support platform is rotatable about said axis when supporting an item when said lift assist device is in said lifting position.

2. The lift assist device of claim 1, wherein said support shaft is adjustable in length to adjust a height of said support platform relative to said base.

3. The lift assist device of claim 2, wherein said support shaft is manually adjustable.

4. The lift assist device of claim 2, wherein said support shaft is automatically adjustable responsive to the position of said lift assist device.

5. The lift assist device of claim 4, wherein said lift assist device is operable to extend said support shaft responsive to detection of said lift assist device being in its lifting position.

6. The lift assist device of claim 5, comprising a detecting device, wherein, responsive to said detecting device detecting that said lift assist device is generally in its lifting position, an actuator extends said support shaft to raise said support platform to a selected height.

7. The lift assist device of claim 6, wherein said detecting device comprises an electrical switch disposed at said base, and wherein said electrical switch detects when said center portion of said base is generally at the floor or support surface.

8. The lift assist device of claim 1, comprising an actuator operable to extend and retract said support shaft to raise and lower said support platform relative to said base, wherein, at least when said lift assist device is in said lifting position, said actuator is operable to extend or retract said support shaft.

9. The lift assist device of claim 1, wherein said base includes a second side portion that is angled relative to said center portion at an opposite side of said center portion from said side portion.

10. A method for lifting an article off of a support surface, said method comprising:

providing a lift assist device having a base, a support shaft and a support platform, wherein said base has a center portion and a side portion that is angled relative to said center portion, and wherein said support shaft extends upward from said center portion of said base, said support shaft having a lower end attached at said center portion and an upper end opposite said lower end, and wherein said support platform is attached at said upper end of said support shaft;

tilting said lift assist device to a loading position, where said side portion of said base rests on a floor or support surface and said support shaft is in a tilted orientation;

lifting an end of an article onto said support platform when said lift assist device is in said loading position, whereby the lifted end of the article is supported by said support platform and an opposite end of the article is supported at the support surface; and with the end of the article supported on said support platform, tilting said lift assist device to a lifting position, where said center portion of said base rests on the floor or support surface and said support shaft is in a generally vertical orientation, wherein the opposite end of the article is raised above the support surface when said lift assist device is tilted to said lifting position.

11. The method of claim 10, further comprising rotating said support platform relative to said base when said lift assist device is in said lifting position to move the opposite end of the article towards a targeted elevated support surface.

12. The method of claim 10, extending said support shaft to raise said support platform a desired amount relative to said base.

13. The method of claim 12, wherein extending said support shaft comprises manually extending said support shaft.

14. The method of claim 12, wherein extending said support shaft comprises automatically extending said support shaft responsive to a position of said lift assist device.

15. The method of claim 14, wherein extending said support shaft comprises automatically extending said support shaft responsive to a detection that said lift assist device is in said lifting position.

16. A lift assist device for assisting a user in lifting an item, said lift assist device comprising:

a base having a center portion and a side portion that is angled relative to said center portion;

a support shaft extending upward from said center portion of said base, said support shaft having a lower end attached at said center portion and an upper end opposite said lower end, wherein said support shaft is adjustable in length to adjust a height of said support platform relative to said base;

a support platform rotatably attached at said upper end of said support shaft and rotatable about an axis that is generally parallel to a longitudinal axis of said support shaft;

wherein said lift assist device is tiltable between a loading position, where said side portion of said base rests on a floor or support surface and said support shaft is in a tilted orientation, and a lifting position, where said center portion of said base rests on the floor or support surface and said support shaft is in a generally vertical orientation;

a detecting device operable to detect when said lift assist device is at said lifting position; and an actuator operable to adjust said support shaft, wherein said actuator is responsive, at least in part, to said detecting device detecting when said lift assist device is at said lifting position, and wherein said actuator automatically adjusts said support shaft to a selected length when said lift assist device is at said lifting position.

17. The lift assist device of claim 16, wherein said detecting device comprises an electrical switch disposed at said base, and wherein said electrical switch detects when said center portion of said base is generally at the floor or support surface.

18. The lift assist device of claim 16, wherein said actuator comprises one of a hydraulic cylinder and a pneumatic cylinder.

19. The lift assist device of claim 16, wherein said base includes a second side portion that is angled relative to said center portion at an opposite side of said center portion from said side portion.

20. The lift assist device of claim 16, wherein said actuator is manually actuatable by a user of said lift assist device to selectively adjust the length of said support shaft.

* * * * *